US010184621B2

(12) United States Patent
Kuo et al.

(10) Patent No.: US 10,184,621 B2
(45) Date of Patent: Jan. 22, 2019

(54) FLASHLIGHT WITH DIFFERENT FLASHING COLORS AND FREQUENCY

(71) Applicant: Li-Yen Chen, Taipei (TW)

(72) Inventors: Sheng-Kuang Kuo, New Taipei (TW); Li-Yen Chen, Taipei (TW)

(73) Assignee: Li-Yen Chen, Taipei (TW)

( * ) Notice: Subject to any disclaimer, the term of this patent is extended or adjusted under 35 U.S.C. 154(b) by 517 days.

(21) Appl. No.: 15/060,744

(22) Filed: Mar. 4, 2016

(65) Prior Publication Data

US 2017/0067605 A1 Mar. 9, 2017

(30) Foreign Application Priority Data

Sep. 8, 2015 (TW) ..... 104214539 U

(51) Int. Cl.
*F21L 4/02* (2006.01)
*F21L 4/08* (2006.01)
(Continued)

(52) U.S. Cl.
CPC ..... *F21L 4/027* (2013.01); *F21L 4/085* (2013.01); *F21V 23/0407* (2013.01);
(Continued)

(58) Field of Classification Search
CPC ..... F21L 4/027; F21L 4/085; F21V 23/0407; F21V 23/0414; F21Y 2113/10; F41G 1/34; F41G 1/35
(Continued)

(56) References Cited

U.S. PATENT DOCUMENTS 6,095,661 A * 8/2000 Lebens ..... F21L 4/027 362/184
6,190,022 B1 * 2/2001 Tocci ..... F21V 33/0064 362/184
(Continued)

FOREIGN PATENT DOCUMENTS

CN 102853270 A 1/2013
TW M366021 U 10/2009
(Continued)

*Primary Examiner* — Robert J May
*Assistant Examiner* — Leah S Macchiarolo
(74) *Attorney, Agent, or Firm* — Rosenberg, Klein & Lee

(57) ABSTRACT

The present invention provides a flashlight, and more particularly a flashlight with two different color lights and flicker frequencies. The flashlight comprises an anterior main body having a lamp housing, a posterior main body having a battery holder, a connecting base used to connect with the battery holder, and a starter for turning on/off the flashlight. Wherein the lamp housing is primarily configured to include a light-emitting chipset and a lens, and the battery holder is configured to accommodate a battery for supplying power. The light-emitting chipset of the present invention comprises at least two LED light-emitting chips that can generate different color lights, and a flicker frequency difference between said two different color lights is at least about 50 Hz. The shocking and dazzling effects of the flashlight are therefore improved by means of these two alternating flashing lights with different light colors and flicker frequencies such that the purposes of self-defense and/or countering and subduing an adversary can be achieved. Moreover, said light-emitting chipset may further comprise a third LED light-emitting chip to generate a non-flashing white light. Such flashlight can be switched between an illumination mode and the flashing mode by use of the function switch.

20 Claims, 6 Drawing Sheets

(51) Int. Cl.
*F21V 23/04* (2006.01)
*F21Y 113/10* (2016.01)
*F21Y 115/10* (2016.01)

(52) U.S. Cl.
CPC ..... *F21V 23/0414* (2013.01); *F21Y 2113/10* (2016.08); *F21Y 2115/10* (2016.08)

(58) Field of Classification Search
USPC ..... 362/110, 111
See application file for complete search history.

(56) References Cited

U.S. PATENT DOCUMENTS

| | | | | |
|---|---|---|---|---|
| 7,845,817 | B1 * | 12/2010 | Miller | F41G 1/35 362/110 |
| 8,419,213 | B1 * | 4/2013 | Rubtsov | F41H 13/0087 340/573.1 |
| 8,894,234 | B2 | 11/2014 | Kuo | |
| 9,658,031 | B1 * | 5/2017 | Hedeen | F41G 1/35 |
| 2008/0013311 | A1 * | 1/2008 | Rubtsov | F41H 13/0087 362/231 |
| 2012/0176780 | A1 * | 7/2012 | Gross | F21L 4/027 362/184 |
| 2014/0313709 | A1 * | 10/2014 | Yuan | F21V 23/0421 362/202 |
| 2016/0330815 | A1 * | 11/2016 | Nakagawa | H05B 37/0227 |
| 2018/0259136 | A1 * | 9/2018 | Horne | F21L 4/027 |

FOREIGN PATENT DOCUMENTS

| | | | |
|---|---|---|---|
| TW | M432743 | U1 | 7/2012 |
| TW | M457820 | U1 | 7/2013 |

* cited by examiner

FLASHLIGHT WITH DIFFERENT FLASHING COLORS AND FREQUENCY

BACKGROUND OF THE INVENTION

The present invention relates to a flashlight, and more specifically to a flashlight with two different color lights, wherein said two different color lights can generate a flicker frequency difference of at least 50 Hz.

Security service providers, such as policemen, private security personnel, soldiers or special agents, may encounter criminals or armed adversaries when performing guard duties and patrols, apprehending criminals, or conducting military operations, putting such security service providers at high risk. Therefore, it is critical to be able to shock the adversaries and force them into submission within a short period. There are several conventional devices capable of emitting flash light to assist said service providers, which are discussed as follows.

The utility model patent No. M366021 of Republic of China (ROC), which was filed on Sep. 5, 2008, and issued on Oct. 1, 2009, is entitled "Flashlight With Multi-Functional LED Pulsed Shock Light And Video Recording For Security". By means of a microprocessor located on a main body of a pulsed shock light master controlling circuit board, the LED (i.e., light emitting diode) may individually emit white, red, blue, yellow or green lights based on instructions. The LED pulsed shock light is monochromic light with a dual-carrier pulsed light of 12~15 Hz plus 50~60 Hz carrier wave. Another prior art, the ROC utility model patent No. M432743 U1, which was filed on Mar. 26, 2012, and issued on Jul. 1, 2012, is entitled "Electronic Equipment Capable of Reducing Criminal Attacking Power". The foregoing Taiwan patent is also issued as U.S. Pat. No. 8,894,234 B2 in 2014, which is entitled "Multi-Color Flashlight Having Guarding Stick" (i.e., said M432743 pertains to the Taiwan counterpart of such U.S. Pat. No. 8,894,234 B2). This prior art discloses an electronic flashlight device comprising a lamp receptacle and a linked stick used as a defense weapon for subduing bandits. Under this patent the pulsed light emitting members on the light casing of said flashlight device is actuated by way of a light controlling device to generate alternatively flashing red and blue LED lights. Although such utility model patent disclosed the utilization of two different alternatively flashing color lights (e.g. red light and blue light) to achieve its shock effect, it was not based on research of the optimal light flicker frequency actuated by the light emitting member. Furthermore, said flashlight device attached to a guarding stick for defense purposes results in a bulky dimension and thus cannot be mounted on a gun barrel. In addition, the ROC utility model patent No. M457820 U1, which was filed on Mar. 15, 2013 and issued on Jul. 21, 2013, disclosed a "Portable Pulse Blazing Device". Except for a fingerprint identification device, the foregoing utility model patent is similar to the electronic equipment capable of reducing criminal attacking power disclosed in the above-mentioned ROC utility model patent No. M432743 U1. However, the prior art did not disclose the employment of flicker frequency difference generated by two different color lights in order to improve the shock effect. Moreover, a further fingerprint identification and comparison will be required for such electronic equipment to turn on the pulsed light controlling device.

Another type of conventional flashlight can emit different color lights to impart delightfulness and joyfulness while using it. For example, an invention patent application publication No. CN 102853270 A disclosed a "Multicolor LED Flashlight". The flashlight of such invention application is configured to have a plurality of LED lamps with different colors on a lighting lamp receptacle so as to impart delightfulness and joyfulness while using the flashlight. However, such flashlight capable of emitting lights of different colors is limited to enhancing delightfulness in use, and thus fails to produce any shocking effect at all. Accordingly, there is still a need to utilize different lights having a flicker frequency difference between them in a conventional pulsed shocking light device or flashlight so as to increase its shock effect.

SUMMARY OF THE INVENTION

In view of the above, the present invention provides a flashlight having two lights with different colors and flicker frequencies. The flashlight primarily comprises an anterior main body, a posterior main body, a connecting base and a starter. Wherein said anterior main body has a lamp housing, and the posterior main body has a battery holder, the connector is configured to be coupled to the battery holder. The connecting base is connected with the battery holder to hold and fix the battery within the battery holder. The starter, which can be positioned on any suitable place of the flashlight, is configured to turn on/off power. For example, such starter can be located at the bottom of said connecting base. Wherein the lamp housing is basically configured to comprise a light-emitting chipset and a lens, while said battery receptacle is used for accommodating a battery for supplying power.

The light-emitting chipset of the present invention comprises at least two LED light-emitting chips that can generate lights with different colors, and a flicker frequency difference between the two emitted different color lights is about at least 50 Hz. The shocking and dazzling effects of the flashlight are therefore improved by means of these two alternate flashing lights with different light colors and frequencies. Moreover, the light-emitting chipset may further comprise a third LED light-emitting chip to generate non-flashing white light. A switching can be made by a function switch on the flashlight so as to switch such flashlight from the illumination mode for ordinary use to a flashing mode to shock an adversary for the purpose of self-defense.

Another objective of the present invention is to provide a flashlight with a light-emitting chipset comprising two LED light-emitting chips. The first LED light-emitting chip and a second LED light-emitting chip can generate light sources with different colors, and the flicker frequency difference between said two different color lights is at least about 50 Hz. For example, the first LED light-emitting chip can generate a red light source having a flicker frequency of about 10~20 Hz, while the second LED light-emitting chip can generate a blue light source having a flicker frequency of about 60~70 Hz. In one embodiment, the flicker frequency of the red light source is in the range of about 12~15 Hz, and the flicker frequency of the blue light source is in the range of about 62~65 Hz. It is observed the light sources with different colors disclosed in the present invention is not limited to a red light source and a blue light source so long as shocking and dazzling effects can be achieved with different color lights and the flicker frequencies. Furthermore, the light-emitting chipset of the present flashlight may further comprise a third light-emitting chip, and the third LED light-emitting chip can generate a non-flashing white light source. By means of a function switch, said flashlight can be switched between an illumination mode and a flashing mode.

In another embodiment of the present invention, the flashlight may further include a charging port located on the anterior main body section such that charging the flashlight can be achieved without the need to remove the battery from said flashlight. The charging port may be equipped with a protective collar to protect said charging port and thus prevent it from being contaminated by dust, water spillage, moisture, and the like. A charging status indicator, which may be an indicating light with different colors, can be further adopted to indicate the charging status of a battery via different color lights.

Yet another objective of the present invention is to provide a flashlight having a replaceable control connector, which can be used for turning on/off and a function switch of the flashlight when said flashlight is mounted onto a firearm by a bracket. The control connector has an extension cord, and a control element extending from the end of the extension cord. It is therefore possible for a user to turn on/off the flashlight, or to switch said flashlight to operate between white light illumination mode and flashing red/blue lights mode.

DETAILED DESCRIPTION

Figure 1:
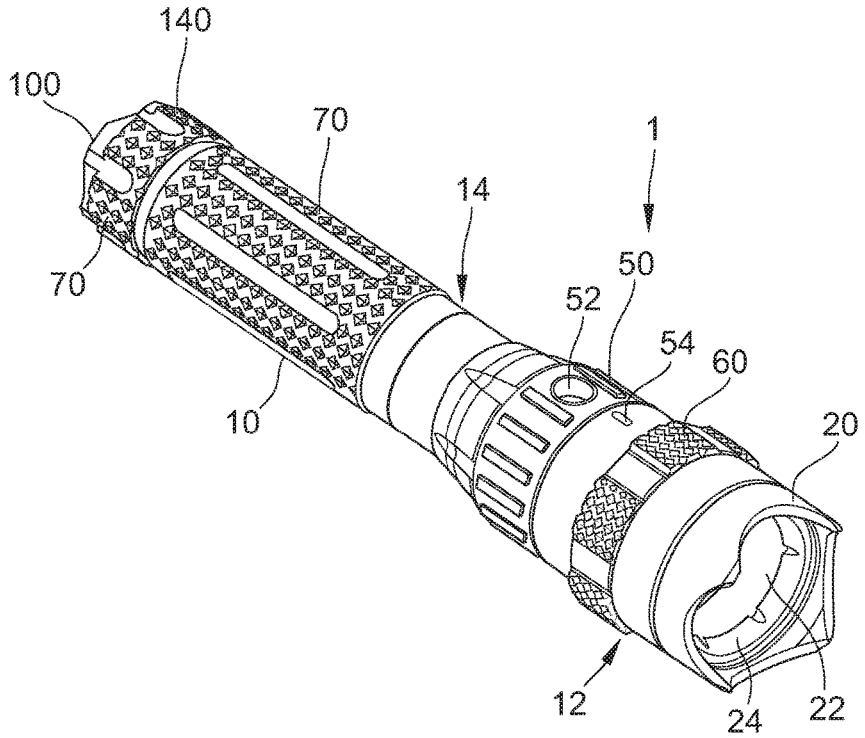
FIG. 1 is a perspective view of an embodiment of the flashlight according to this invention.
Figure 2:
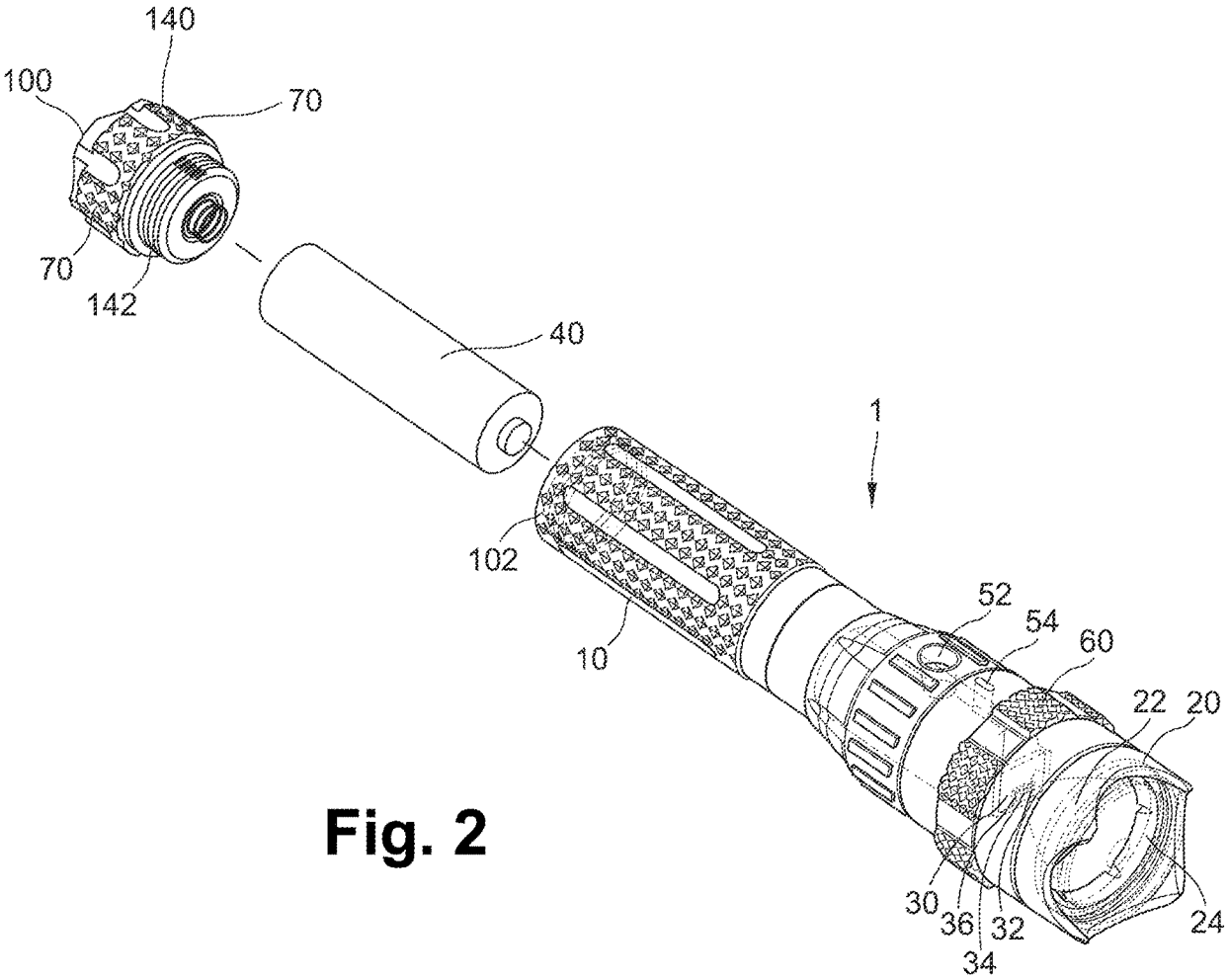
FIG. 2 is an exploded view of the flashlight illustrated in FIG. 1.
Figure 3:
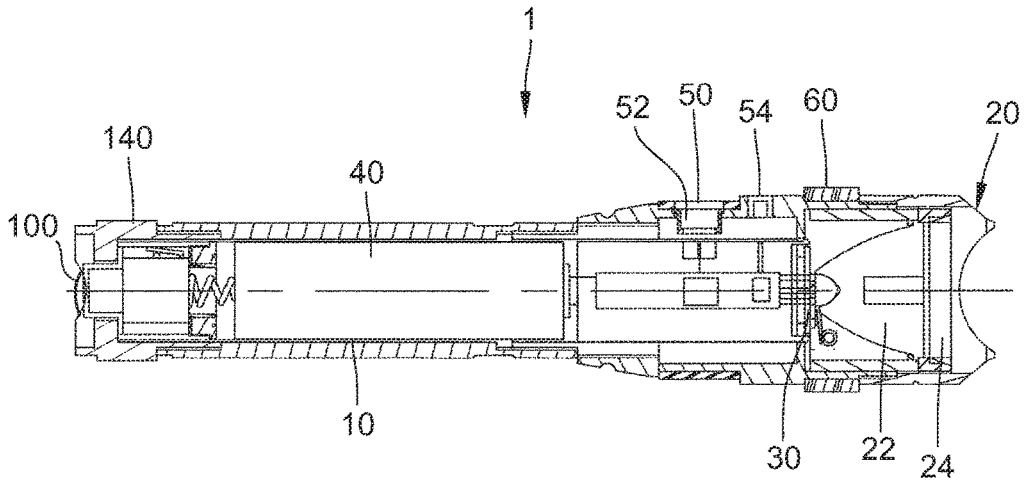
FIG. 3 is a sectional view of the flashlight illustrated FIG. 1.

Now referring to FIGS. 1, 2 and 3, as it can be clearly shown, the flashlight 1 of the present invention primarily comprises an anterior main body 12, a posterior main body, a connecting base 140 and a starter 100. The anterior main body 12 includes a lamp housing 20, and the posterior main body 14 includes a battery holder 10. Said connecting base 140 is connected with the battery holder 10 to accommodate the battery/batteries in said battery holder 10. The starter 100 for turning on/off the flashlight can be located on any suitable position of the flashlight 1. As shown in the drawings, said starter 100 can be optionally positioned on the bottom of the connecting base 140. Wherein a light-emitting chipset 30 and a lens 22 are configured to be included in the lamp housing 20, and said lens (22) can be engaged and attached to the lamp housing 20 via a lens holder 24. Furthermore, a threaded connection part 142 of the connecting base 140 can be screwed onto a connected part 102 with corresponding threads of the battery holder 10 so as to fasten the connecting base (140) onto the battery holder 10. It should be understood that any suitable structure and means which can be utilized to attach the connecting base 140 to the battery holder 10 can be applied in the flashlight 1 according to present invention.

The light-emitting chipset 30 within the lamp housing 20 of the present invention comprises at last two LED light-emitting chips with different colors, and a flicker frequency difference between said two different color light sources is at least about 50 Hz. The light intensity of the light-emitting chipset 30 can be increased by the lens 22. For example, the light-emitting chipset 30 may comprise a first LED light-emitting chip 32 and a second LED light-emitting chip 34. The first LED light-emitting chip 32 may generate a red light source with a flicker frequency of about 10~20 Hz, while the second light-emitting chip 34 may generate a blue light source with a flicker frequency of about 60~70 Hz. In one embodiment of the present invention, the flicker frequency of said red light source is in the range of about 12~15 Hz, and the flicker frequency of said blue light source is in the range of about 62~65 Hz. The shocking and dazzling effects of the flashlight are therefore significantly improved by way of these red light and blue light sources with flicker frequency difference there between that flash alternatively. It should be appreciated that the light sources with different colors employed in the present invention will not be limited to red light and blue light sources, so long as desired shocking and dazzling effects can be generated from these different color lights with different flicker frequencies. Because of the vision persistence phenomenon of human eyes, a single flashing light may result in an interference to a person's vision. However, by using such two alternate flashing lights with different colors and flicker frequencies as set out in the present invention, the interference to vision will be enhanced, which significantly improves the desired shock and dazzling effects.

Furthermore, the light-emitting chipset 30 may further comprise a third LED light-emitting chip 36, which can generate a white light source. A switching can be made by a function switch 60 on the flashlight 1 such that to the flashlight 1 can switch between an illumination mode for illumination purpose during ordinary use period and a flashing mode with alternate flashing red/blue lights while encountering an adversary or in an emergency for the purpose of self-defense. The function switch 60 may be positioned on any suitable position of the flashlight 1. Alternatively, as shown in the figures, said function switch 60 can be optionally located on the anterior main body 12 adjacent to the lamp housing 20. Said function switch 60 may optionally be a left-right rotating wheel switch. An additional anti-slip material may be further included on the outer surface of the switch such that it is easier for a user to proceed with operating the flashlight functions. However, said function switch 60 may be designed as a press-button switch, touch switch, or other similar options.

Figure 5:
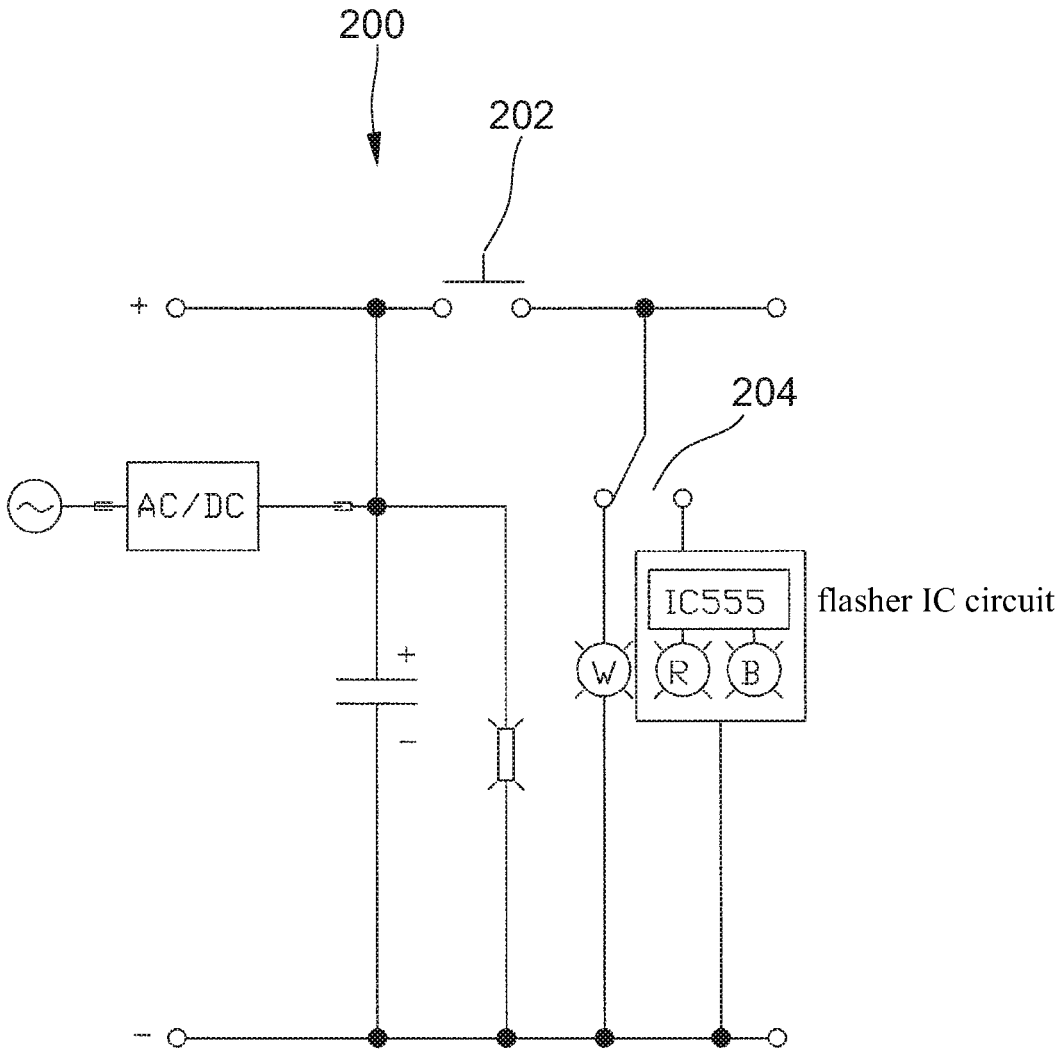
FIG. 5 is a circuit diagram of one embodiment of the flashlight according to this invention.

Now referring to a circuit 200 shown in FIG. 5, the starter 100 on the bottom of the connecting base 140 is used to turn on a power supply via connecting a starting switch 202 of the circuit 200. Then utilizing the function switch 60 to switch a changeover switch 204 between the illumination mode for white light source and the flashing mode for generating red/blue flashing lights.

The outer surface of the battery holder 10 of the flashlight 1, alternatively may include the outer surface of the connecting base 140, can both be provided as gripping portion for the user to hold said flashlight 1. The anti-slip material 70 may be further positioned on the gripping portion so as to enhance the holding stability of said flashlight and to prevent an unintended released from a user's hands during usage. A charging port 52 may be located on the anterior main body 14 of the flashlight 1 for charging such that it is therefore possible to charge said flashlight 1 without the need to remove the battery 40. A protective collar 50 may be positioned outside the charging port 52, which can be rotated to cover up the opening of the charging port 52 while said flashlight is not charging so as to prevent the charging port from being contaminated by dust, water spillage or moisture.

A charging status indicator 54 can be provided in the proximity of the charging port 52, which may be an audible buzzer, or an indicating light with different colors used for indicating the charging status of the battery 40. Although a rechargeable battery is used as an exemplary sample in the embodiment of the present invention, it is pointed out the battery used in said flashlight 1 can also be a non-rechargeable battery.

Figure 4:
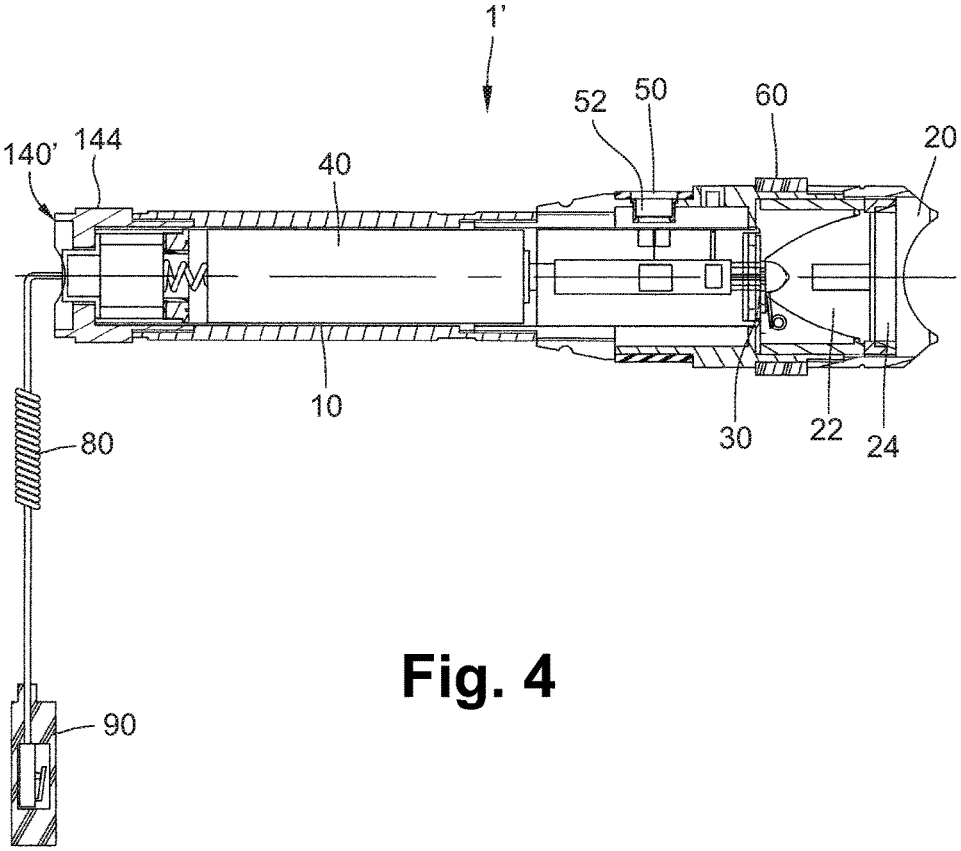
FIG. 4 is a sectional view of another embodiment of flashlight according to this invention.
Figure 6:
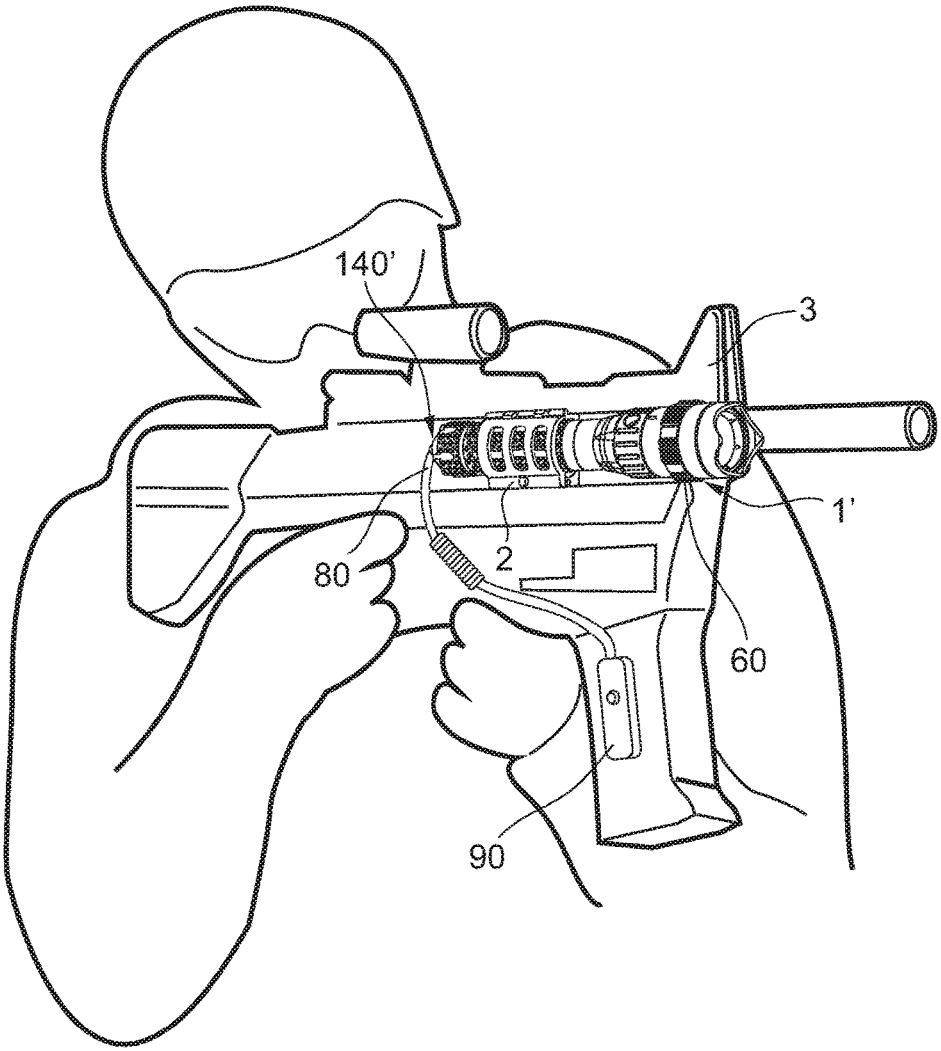
FIG. 6 is a perspective view that the flashlight according to this invention is mounted on a firearm.

Yet another objective of present invention is to provide a flashlight 1' having a replaceable control connector 140' such that when said flashlight 1' is mounted onto a firearm, said control connector 140' can be used for turning on/off and function switching of the flashlight. As illustrated in FIG. 4, the control connector 140' has a base 144, an extension cord 80 extending from said base 144, and a control element 90 connecting with said extension cord 80. The control element 90 can be used to turn on or off the flashlight 1' or alternatively to switch between white light illumination mode and red/blue lights flashing mode. Now referring to FIG. 6, the present invention can optionally use a bracket 2 to fasten the flashlight 1' onto another object. For example, the present flashlight 1' may be fixed onto a firearm 3 as shown in such figure. Because the operation of said function switcher 60 will be restricted while mounting the present flashlight 1' onto said firearm 3, the control element 90 may thus be sued for turning on/off the power supply, and for switching said flashlight 1' to switch between the illumination mode and the flashing mode.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A flashlight comprising:

an anterior main body including a lamp housing, said lamp housing has a lens and a light-emitting chip set in there;

a posterior main body including a battery holder, said battery holder can be used to accommodate a battery for supplying power;

a connecting base, which can be attached to the battery holder of the posterior main body; and a starter located on the flashlight for turning on or off power supply;

wherein the light-emitting chipset comprises at least two LED light-emitting chips with different color lights, and a flicker frequency difference among light sources of said different color lights generated by at least two LED light-emitting chips is at least about 50 Hz, the flashlight is capable of generating alternate flashing lights with at least two different color lights and flicker frequencies after turning on the power by the starter.

2. The flashlight of claim 1, wherein the light-emitting chipset comprises a first LED light-emitting chip and a second LED light-emitting chip, said first LED light-emitting chip can generate a red light source with a flicker frequency of about 10 to 20 Hz, and the second LED light-emitting chip can generate a blue light source with a flashing frequency of about 60 to 70 Hz.

3. The flashlight of claim 2, wherein the flicker frequency of said red light source is in the range of about 12 to 15 Hz, and the flicker frequency of said blue light source is in the range of about 62 to 65 Hz.

4. The flashlight of claim 1, wherein said starter is located at the bottom of the connecting base.

5. The flashlight of claim 1, wherein the anterior body can further comprise a charging port.

6. A flashlight comprising:

an anterior main body including a lamp housing, said lamp housing has a lens and a light-emitting chipset in there, wherein the light-emitting chipset comprises a first LED light-emitting chip, a second LED light-emitting chip and a third light-emitting chip, wherein the first LED light-emitting chip and the second light-emitting can generate alternate flashing light sources with different color lights, a flicker frequency difference between the foresaid two light sources of the different color lights is at least about 50 Hz, and the third LED light-emitting chip can generate a non-flashing white light source;

a function switcher on the flashlight is used to switch between a flashing mode formed by said two alternate flashing light sources with different color lights and a illumination mode formed by said non-flashing white light;

a posterior main body comprising a battery holder, said battery holder can be used to accommodate a battery for supplying power;

a connecting base, which can be attached to the battery holder of the posterior main body; and a starter on said flashlight to turn on or off the power.

7. The flashlight of claim 6, wherein the first LED light-emitting chip can generate a red light source with a flicker frequency of about 10 to 20 Hz, and the second LED light-emitting chip can generate a blue light source with a flicker frequency of about 60 to 70 Hz.

8. The flashlight of claim 7, wherein the flicker frequency of said red light source is in the range of 12 to 15 Hz, and the flicker frequency of said blue light source is in the range of 62 to 65 Hz.

9. The flashlight of claim 6, wherein said function switch is a left-right rotating wheel switch located on the anterior main body in the proximity of the lamp housing.

10. The flashlight of claim 6, wherein said starter is located at the bottom of said connecting base.

11. The flashlight of claim 6, wherein the anterior main body can further comprise a charging port.

12. The flashlight of claim 11, wherein said charging port can further comprise a protective collar.

13. The flashlight of claim 11, further comprises a charging status indicator located in the proximity of the charging port.

14. The flashlight as of claim 6, wherein a surface of gripping portion formed by said posterior main body and said connecting base can further include an anti-slip material.

15. A flashlight as defined in claim 6, comprising:

a control connector is used to replace said connecting base, said control connector includes:

a extension cord extending from a base of said control connector; and a control element connecting to the said extension cord, wherein the flashlight can be turned on or off via said control element.

16. The flashlight of claim 15, where said control element can further used to switch between the white light illumination mode and the flashing mode.

17. The flashlight of claim 15, wherein the first LED light-emitting chip can generate a red light source with a flicker frequency of about 10 to 20 Hz, and the second LED light-emitting chip can generate a blue light source with a flicker frequency of about 60 to 70 Hz.

18. The flashlight of claim 17, wherein the flicker frequency of said red light source is in the range of 12 to 15 Hz, and the flicker frequency of said blue light source is in the range of 62 to 65 Hz.

19. The flashlight of claim 15, wherein the anterior main body can further comprise a charging port.

20. The flashlight of claim 15, further comprises a bracket sued for fixing said flashlight onto other devices, such devices comprise firearms.

* * * * *